United States Patent [19]

Arft

[11] Patent Number: 4,800,598

[45] Date of Patent: Jan. 31, 1989

[54] ANTI-TILT SOFA SLEEPER MECHANISM

[75] Inventor: Dennis E. Arft, Joplin, Mo.

[73] Assignee: Leggett & Platt, Incorporated, Carthage, Mo.

[21] Appl. No.: 127,252

[22] Filed: Dec. 1, 1987

[51] Int. Cl.[4] ..... A47C 17/14

[52] U.S. Cl. ..... 5/13; 5/29

[58] Field of Search ..... 5/13, 28, 29, 12, 30, 5/31, 35, 36, 51 R

[56] References Cited

U.S. PATENT DOCUMENTS

| | | | |
|---|---|---|---|
| 1,448,127 | 3/1923 | Konroad . | |
| 2,722,016 | 11/1955 | Pokorny et al. | 5/13 |
| 3,292,188 | 12/1966 | Gerth | 5/13 |
| 3,525,106 | 8/1970 | Perry | 5/13 |
| 4,571,755 | 2/1986 | Stevens | 5/13 |

*Primary Examiner*—Alexander Grosz

*Attorney, Agent, or Firm*—Wood, Herron & Evans

[57] ABSTRACT

A foldable sofa sleeper mechanism having pivotally interconnected head, body, intermediate, and foot sections movable between a folded position in which the mechanism is contained within a storage enclosure of a sofa frame, and an extended unfolded position in which the bed frame extends in a planar attitude away from the sofa frame, and tilt prevention means for preventing the head end of the unfolded sofa sleeper mechanism from tilting downwardly when an excessive weight is placed thereon, which tilt prevention means includes at least one flexible, non-stretchable cable fixedly connected to two locations on the mechanism.

8 Claims, 3 Drawing Sheets

ANTI-TILT SOFA SLEEPER MECHANISM

BACKGROUND OF THE INVENTION

This invention relates to a sofa sleeper and, more particularly, to a sofa sleeper of the type which includes a foldable bed having head, body, intermediate and foot sections which are foldable and which may be collapsed and hidden in the bottom of the sofa frame when the sofa sleeper is used as a seating surface.

Sofa sleeper mechanisms generally comprise a four-section foldable bed frame including pivotally interconnected head, body, intermediate and foot sections which are adapted to be moved between a fully folded or retracted position contained within a box-like sofa frame, and an extended position wherein the sections extend out and over the front rail of the sofa frame to form an extended flat bed. The head, body, intermediate and foot sections of the bed frame each include a pair of opposed side frame members, usually in the form of angles or tubes, which are pivotally connected at their ends so that the sections are foldable or collapsible upon one another. The side frame members support a link or cloth fabric over which a mattress is placed. The bed frame is supported when in the extended bed position by linkage mechanisms at the head end and by a plurality of foldable legs at the center and foot end of the frame.

A common problem characteristic of sofa sleepers is that when folded out into the flat bed sleeping position, they are subject to tilting about the linkage mechanism which supports the foldable bed frame from the wooden sofa frame. Such tilting occurs when excessive weight is applied to the head section of the sofa sleeper. In that event, the foot end of the sofa sleeper tips up in the air, and the head end tips downwardly. This phenomena commonly occurs whenever one or more persons sit on the head end of the unfolded sofa-sleeper mechanism, as for example, to watch TV, or if a person stands on the head end of the unfolded bed, as for example, to adjust curtains behind the bed. In either event, the head end of the unfolded sleeper mechanism drops down while the foot end lifts upwardly, thereby dropping the person whose weight is causing the mechanism to tilt down into the cavity of the wooden sofa frame. Manifestly, such tilting is undesirable.

There have been sofa sleeper mechanisms which included a locking mechanism for preventing tilting of the sofa-sleeper mechanism when in the unfolded condition. Such prior art mechanisms are characterized by multiple link locking mechanisms, as for example, the anti-tilt locking mechanism disclosed in Gerth U.S. Pat. No. 3,292,188. The difficulty with such anti-tilt locking mechanisms is that they all require multiple links or linkage elements to effect the lock and are all subject to criticism because of the added expense those multiple link locking mechanisms add to the sofa-sleeper mechanism. They are also subject to failure in the event that the linkages bend or the pivots about which the multiple links are mounted become worn or broken.

It has therefore been an objective of this invention to provide an improved anti-tilt sofa-sleeper mechanism which does not utilize multiple links and which is much less expensive to add to a sofa-sleeper mechanism than the multiple link locking mechanisms of the prior art.

This objective is accomplished and this invention is predicated upon the concept of connecting an anti-tilt, flexible, non-stretchable cable between two locations on the mechanism such that the cable is taut when the mechanism is unfolded to a bed position, in which taut position it will prevent the unfolded mechanism from tilting to drop the head end of the unfolded mechanism, and which cable will become relaxed or coiled and not interfere with folding of the mechanism when the mechanism is folded into the sofa frame.

SUMMARY OF THE INVENTION

According to the practice of this invention, a foldable sofa-sleeper mechanism is mounted upon a sofa frame in such a manner that it may be stored within a storage enclosure of the sofa frame. The mechanism includes a bed frame having pivotally interconnected head, body, intermediate and foot sections, as well as a mattress supporting fabric extended between opposed side rails of the sections. This mechanism includes a pair of center legs connected to a center actuating arm operable to retract the center legs beneath the body section of the frame when the mechanism is folded into the sofa frame and to extend the center legs into an unfolded vertical orientation beneath the center section of the bed frame when the bed frame is extended into a horizontal flat orientation. A tilt prevention cable extends between two points on the unfolded mechanism in such a fashion as to prevent the mechanism from tilting in response to a downward force upon the head end of the sofa-sleeper mechanism. In the preferred practice of this invention the bed frame is pivotally supported from the sofa frame upon a pilot arm, and the flexible cable extends between the pilot arm and a side rail of the bed frame.

The primary advantage of this anti-tilt sofa-sleeper mechanism is that it provides an anti-tilt feature which may be relatively inexpensively added to any conventional foldable sofa-sleeper mechanism. It also is advantageous because it enables the sofa-sleeper mechanism to be secured against tilting movement with a relatively inexpensive anti-tilt mechanism.

These and other objects and advantages of this invention will be more readily apparent from the following description of the drawings in which.

Figure 2:
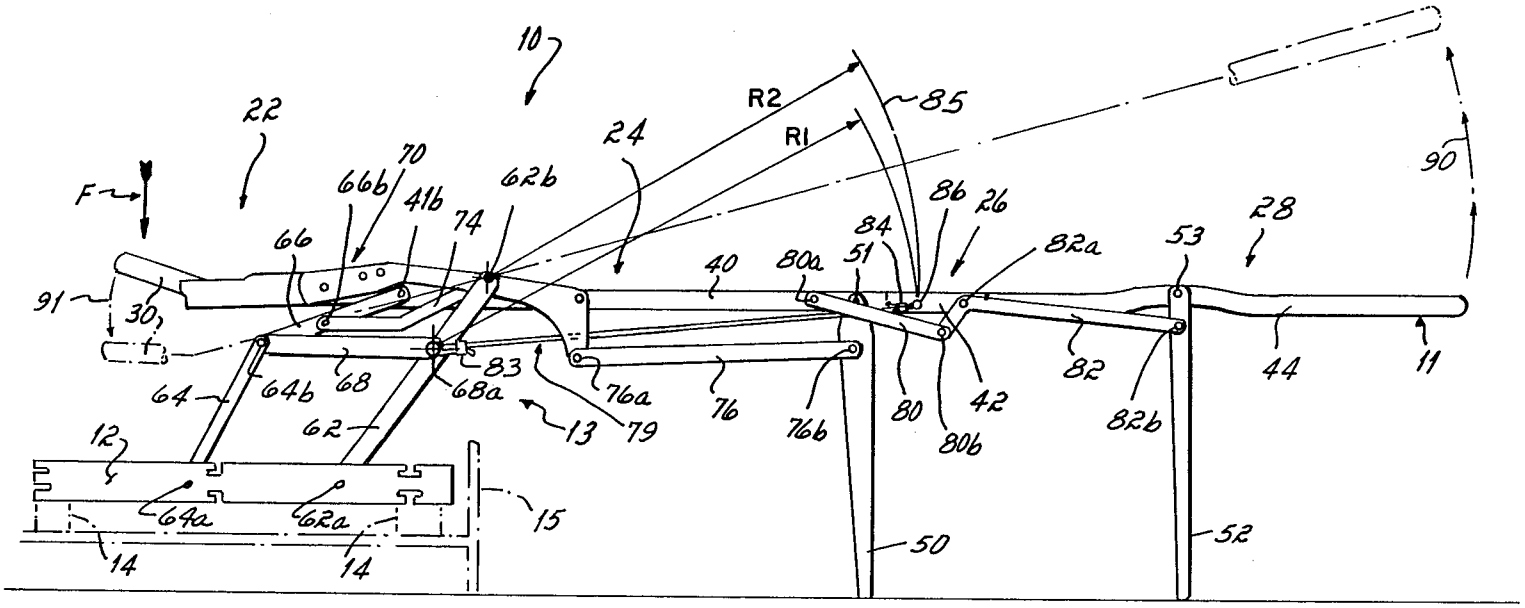
FIG. 2 is a side elevational view of the mechanism of FIG. 1, illustrating in phantom the manner in which the mechanism could be tilted in the absence of the anti-tilt feature of this invention.
Figure 3:
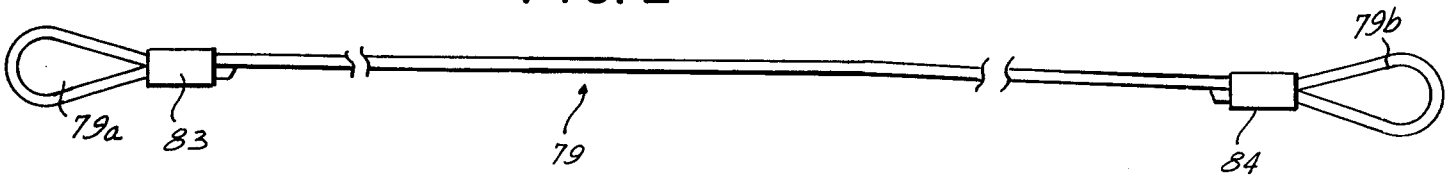
FIG. 3 is a side elevational view of the anti-tilt cable utilized in the practice of this invention.
Figure 4:
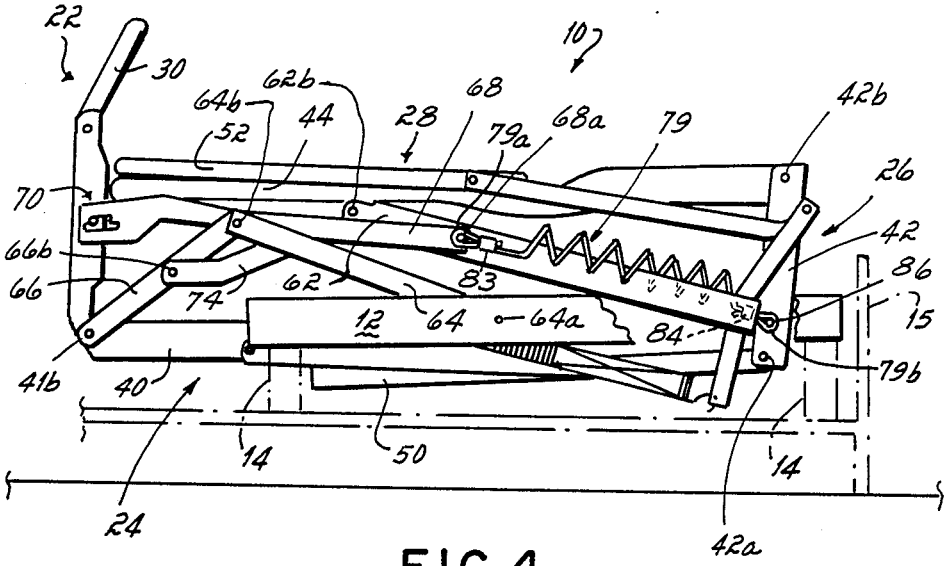
FIG. 4 is a side elevational view of the mechanism of FIG. 1, but in the folded condition of the mechanism.

Referring now to the drawings, it will be noted that the sofa-sleeper mechanism 10 is supported from a pair of mounting plates 12 which are fixedly secured to an upholstered sofa frame, indicated generally by the numeral 14 (FIGS. 2 and 4). The upholstered sofa frame conventionally has a backrest cushion (not shown), a pair of side rails (not shown) and a fixed front rail 15 which define a generally rectangular storage enclosure for the folded mechanism 10 (FIG. 4). The sofa frame 14 per se does not form any part of the invention of this application and may comprise any standard upholstered frame.

The foldable sofa-sleeper mechanism 10 comprises a bed frame 11 and a linkage mechanism 13 for supporting that frame 11 from the mounting plates 12. The bed frame 11 comprises a rear head section 22, a long body section 24 pivotally connected at one end to the head section 22, a short intermediate section 26 pivotally connected at one end to the other end of the body section 24, and a foot section 28 pivotally connected to the other end of the short intermediate section 26. The head section 22 comprises symmetrically disposed left and right side members 30. In the illustrated embodiment, these side members are tubular in configuration and are interconnected by a cross member 36 which comprises a transverse tubular section of the side members 30.

The body section 24, the short intermediate section 26, and the foot section 28 each comprises symmetrically disposed left and right side members 40, 42 and 44, respectively. The body section side frame members 40 and the foot section side frame members 44 are tubular in configuration, while the intermediate frame section 42 is channel shaped. A transverse cross member 46 connects the forward ends of the foot section side members 44. In the preferred embodiment, the foot section side members 44 and the transverse cross member 46 are bent from a single unitary tube.

The interconnected bed frame sections 22, 24, 26 and 28 are supported in their extended position by a pair of foldable center support legs 50 pivotally connected to the forward ends of the body section side members 40 by rivets 51. A generally U-shaped foot section support leg 52 is pivotally connected at its upper ends by rivets 53 to the foot section side members 44. A tubular cross member 54 interconnects the center legs 50 and is riveted thereto to provide the legs 50 with lateral stability.

A cross brace 56 extends between the opposite side members 40 of the body section 24. A similar cross brace 58 extends between the side members 42 of the intermediate section 26 of the mechanism. The opposite ends of each of these cross braces 56, 58 is fixedly attached to the side members of the body section and intermediate section of the mechanism, respectively, so as to provide lateral stability to the bed frame.

Stretched between the side frame members of the head, body, intermediate and foot sections of the frame is a fabric 60 for supporting a mattress atop the mechanism. The fabric 60 may be a wire link fabric or a cloth fabric or any other conventional mattress supporting flexible fabric material. Such fabric materials are conventional and per se form no part of the invention of this application.

The interconnected sections 22, 24, 26 and 28 together form the rectangular bed frame 11 with curved corners when the mechanism 10 is fully pulled out. As may be seen in FIGS. 1 and 2, the sections lie in coplanar relationship, i.e., they all lie on the same horizontal plane and provide a resilient planar surface for supporting a mattress (not shown).

The foldable frames on both sides of the bed are similar and are symmetrically disposed. Since the means which connect the longitudinal portions of the bed frame on the right and left facing sides of the bed are similar and symmetrically disposed, only the connections on one side have been illustrated and will be described herein. The side of the frame shown in FIGS. 2 and 4 is the left facing side of the bed which is the side on the left side of a person standing in front of the foot end of the bed and looking toward the head end of the bed.

The side members 30 of the head section 22 are connected to the rearward end of the side members 40 of the body section by a rear support channel 41. This channel is pivotally connected to the member 30 by a rivet **41*a* and is connected to the rearward end of the side members 40 of the body section by a rivet 41*b*. These rivet connections enable the channel 41 to pivot relative to the side members 40 of the body section and enable the side members 30** of the head section to pivot relative to the channel.

Similarly, the forward end of the side members 40 of the body section are pivotally connected to the intermediate frame section members 42 by a pivot **42*a*. At the forward end, the intermediate frame section members 42 are pivotally connected by a rivet 42*b* to the rearward end of the side members 44 of the foot section 26 of the mechanism. The side members 42** are both channel shaped in configuration so as to enable the top surfaces of the channels to function as stops for maintaining the side members in a horizontal plane when the frame is unfolded.

Figure 1:
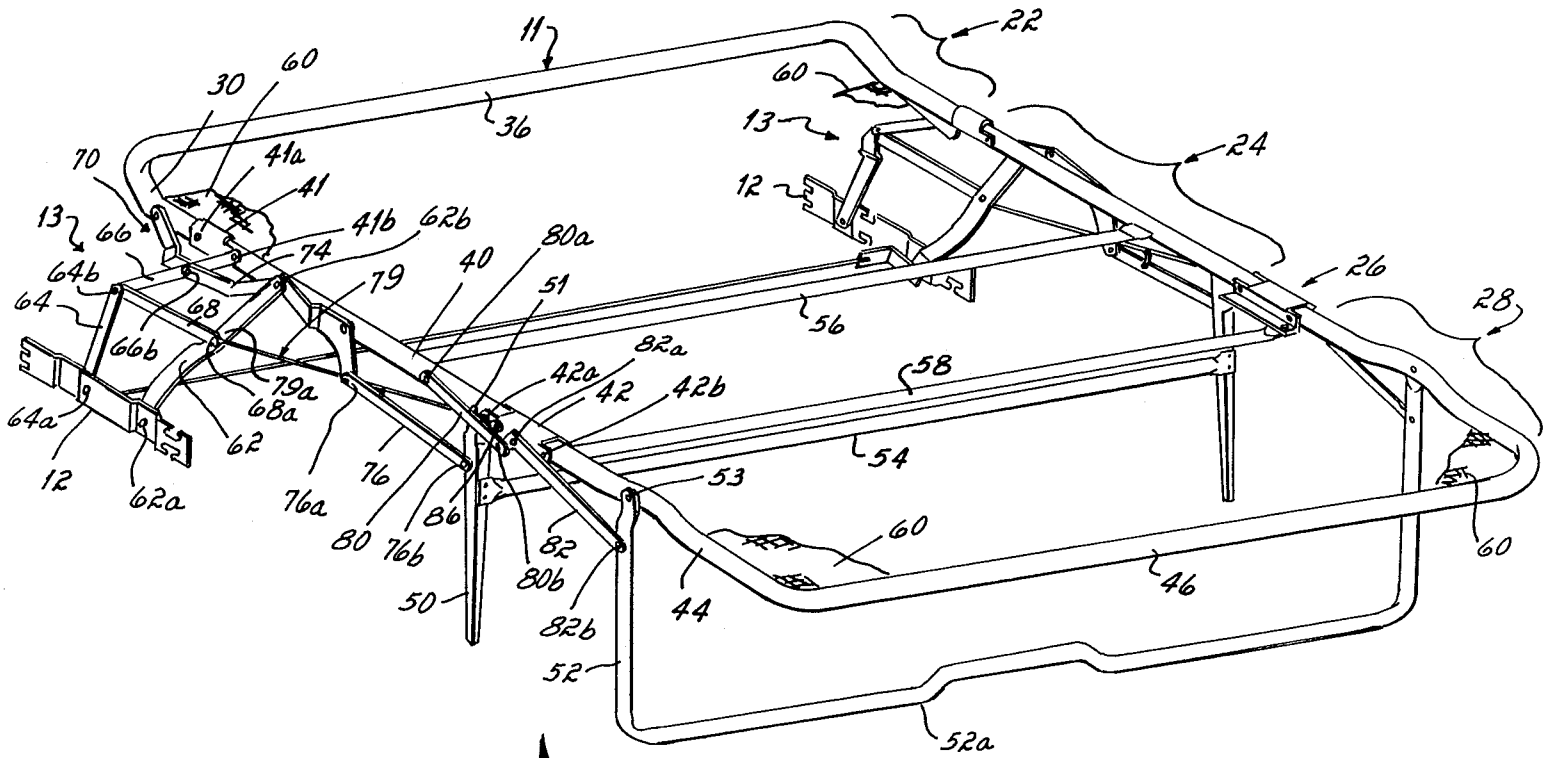
FIG. 1 is a perspective view of an unfolded sofa-sleeper mechanism incorporating the invention of this application.

Referring now to FIGS. 1 and 2, it will be seen that the sofa-sleeper mechanism 10 is supported upon the sofa frame by a series of links supported from the mounting plate 12. This mounting plate is secured to the sofa frame 14 by conventional screws or fasteners (not shown). Pivotally mounted upon this mounting plate is a pilot arm 62, the lower end of which is pivotally connected to the mounting plate by a rivet **62*a* and the upper end of which is pivotally connected to an actuating link 74 by a rivet 62*b*. A pair of interconnected lower and upper rear support links 64, 66, respectively, interconnect the side members of the body supporting section of the frame to the mounting plate. The lowermost one 64 of these links is pivotally attached to the mounting plate by a rivet 64*a*, and the upper end of the uppermost one 66 of these supporting links is pivotally secured to the rear of the side member of the body supporting section 24 of the frame by a rivet 41*b*. The two links 64, 66 are interconnected at their upper and lower ends, respectively, by a rivet 64*b*. The pilot arm 62 and the lower rear support link 64 are interconnected by a control link 68 which is pivotally connected to each link by a rivet 68*a* and 64*b***, respectively.

A conventional TV star lock mechanism indicated generally by the numeral 70, including a rotating TV link, interconnects the upper rear support link 66 with the side members of the head section of the frame. This conventional mechanism enables the head section of the frame to be pivoted and locked in an upwardly sloping position relative to the side members of the body section of the frame so as to facilitate TV viewing or reclining on the unfolded bed with the head end of the bed tilted upwardly. Since this mechanism 70 is conventional and forms no part of the invention of this application, it has not been described in detail herein.

The actuating link 74 interconnects the upper rear support link 66 and the side member 40 of the body supporting section 24 of the mechanism. This actuating link is pivotally connected to the upper rear supporting link 66 by a rivet **66*b* and is connected to the side member 40 of the body supporting section 24 of the mechanism by the rivet 74*a***.

The actuating link 74 extends forwardly from its pivotal connection **62*b* with the upper end of the pilot arm to the pivotal connection via the rivet 74*a* with the side member 40 of the body section of the bed frame 11 to a rivet connector 76*a* with a center leg actuating arm 76. At its forward end, the actuating arm 76 is pivotally connected to the center leg 50 via a rivet 76*b*. As is conventional in such foldable sofa sleeper mechanisms, the actuating link 74** cooperates with the actuating arm 76 to effect inward folding of the leg 50 about its pivotal connection 51 against the side member 40 of the body section of the frame when the mechanism is collapsed during folding into the sofa frame 14.

In order to actuate the front leg so as to cause it to move upwardly to position the transverse leg tube 52*a* in juxtaposition to the transverse tube 46 of the foot section of the frame, a pair of links, a compression lock link 80, and a leg lock link 82, interconnect the upper end of the front leg 52 with the side member 40 of the body section of the frame and with the side member 42 of the intermediate section of the frame, respectively.

The compression lock link 80 is pivotally connected to the side member 40 by a rivet 80*a* and is pivotally connected to the rearward end of the leg lock link 82 via a rivet 80*b*. The leg lock link 82 is pivotally connected via a rivet 82*a* to the side members 42 of the intermediate section 24 of the frame and is connected at its forward end to the leg 52 via a rivet 82*b*. This connection of the front leg to the side members of the frame is also conventional and is operative to collapse the front leg of the frame into juxtaposition with the foot section of the mechanism when the mechanism is collapsed preparatory to being folded into the sofa sleeper frame.

Mechanism Operation

Folding of the mechanism into the cavity of the sofa frame 14 from the flat bed position illustrated in FIGS. 1 and 2 to the collapsed position of the sofa mechanism within the storage enclosure of the sofa sleeper frame 14 illustrated in FIG. 4 is accomplished in the conventional manner and has therefore not been illustrated and described in detail herein. It is illustrated and described in a very similar sofa-sleeper mechanism in U.S. Pat. No. 4,571,755 assigned to the assignee of this application. It is also illustrated and described in numerous other sofa sleeper patents having similar sofa-sleeper mechanism linkages for collapsing and folding a mattress supported by the mechanism into and locating that mechanism and mattress within the storage cavity of a sofa sleeper.

Basically, the mechanism is folded from the flat bed position illustrated in FIGS. 1 and 2 into the collapsed sofa position illustrated in FIG. 4 by first lifting the front tubular cross member 46 of the foot section of the mechanism until that foot section is located in a vertical plane. As a consequence of this movement, the front leg 52 is caused by the leg lock link 82 and the compression lock link 80 to be folded into juxtaposition with the side members of the foot section 28 of the mechanism.

Continued pushing against the now vertically oriented leg cross tube 52*a* and foot section cross member 46 causes the mechanism to pivot about the pivot point or rivet 42*a* connecting the intermediate frame section 26 to the body section 24, thereby lifting the intermediate frame section 26 into a vertical position and simultaneously positioning the foot section 28 of the mechanism in a horizontal plane overlying the body section 24.

Continued folding movement of the mechanism is then effected by lifting the cross tie member 58 upwardly so as to lift what is now the front of the partially folded mechanism, including the center leg 50, upwardly. This upward movement of the folded foot and intermediate sections of the frame causes the actuating link 74 and actuating arm 76 to collapse the center legs 50 beneath the body section 24 of the frame. Continued lifting of the front section of the folded leg and intermediate sections of the frame causes the rear end of the body section of the mechanism to be lowered and moved rearwardly. Simultaneously, the head section 22 is moved into an inclined position with respect to the body section 24 preparatory to the head section of the frame being moved up into the cavity in the backrest section of the sofa frame. On further movement of the folded frame, the head section continues to rotate until the head section is perpendicular to the body section and the body section is located in a horizontal plane internally of the enclosure of the sofa frame, as illustrated in FIG. 4.

The mechanism 10 described hereinabove and the manner in which it is folded into the enclosure of the sofa frame 14 and unfolded therefrom into the flat bed position illustrated in FIGS. 1 and 2 is conventional and per se forms no part of the invention of this application. In fact, other conventional mechanisms could as well be utilized in the practice of this invention.

Anti-Tilt Mechanism

With reference to FIG. 2 there is illustrated in phantom lines the manner in which the complete unfolded horizontal bed frame may be tilted downwardly at the head end and upwardly at the foot end when a very large force F is applied to the head end of the unfolded mechanism. As there illustrated and in the absence of the anti-tilt mechanism of this invention, the horizontal bed frame 11 of the mechanism 10 may all pivot about the pivot connection or rivet 62*b* of the pilot arm to the actuating link 74 so as to cause the head end of the mechanism to drop downwardly, and the foot end to lift upwardly. Such a force F can be applied to the head end of the mechanism when it is in an unfolded condition when one or more persons sit on the head end to watch TV or stand on the head end to reach curtains behind the head end of the mechanism or otherwise apply a very heavy force F To the head end. Upon such tilting, the person applying the force F is caused to drop downwardly into the storage enclosure of the sofa frame.

To prevent such tilting of the unfolded mechanism, the mechanism of this invention includes an anti-tilt, non-stretchable, flexible cable 79 connected at one end to the pilot arm 62 and at the opposite end to the side members 42 of the intermediate section 26 of the mechanism. This cable has loops 79*a*, 79*b* formed in its opposite ends and secured by wire clips 83, 84. These loops are secured beneath the heads of rivets 68*a*, 86 which extend through the pilot arm 62 and the side members 42, respectively. When the bed is unfolded, as illustrated in FIGS. 1 and 2, this cable is taut. So long as this cable is taut when the bed is in its unfolded flat condition and is unstretchable, the unfolded mechanism cannot be caused to tilt when a force F is applied to the head end of the mechanism. The reason that the mechanism cannot be tilted upwardly is because the radius R1 of the rivet 86 about the rivet 68*a* is less than the distance from the rivet 68*a* to the arc 85 swung by the rivet 86 when it pivots upwardly on the radius R2 about the pivot point 62*b*. Consequently, in order for the mechanism to tilt upwardly at the foot end, the anti-tilt cable 79 would have to stretch, but since that cable is not stretchable, something would have to break before the mechanism could tilt as indicated by the arrows 90, 91 of FIG. 2.

To ensure that the cable 79 does not become tangled and interfere with the mechanism 10 when the mechanism is folded and/or unfolded, the cable 79 is a self-coiling cable, similar to a conventional telephone cable, which will automatically coil itself into a helical configuration when relaxed, as illustrated in FIG. 4. As an alternative to the use of a self-coiling cable, the cable 79 may be tied by a short length of additional cable to a link of the mechanism which prevents tangling of the cable when it is relaxed upon folding of the mechanism 10.

As will now be readily apparent, the provision of an anti-tilt cable secured to one side or two cables, each secured to one of the two sides of the mechanism, ensures that the unfolded mechanism cannot be tilted when a force is applied to the head end of the unfolded mechanism. This cable is relatively inexpensive and has the advantage of being easily added to any sofa-sleeper mechanism so as to give to that mechanism an anti-tilt feature.

While I have described only a single preferred embodiment of my invention, persons skilled in this art will appreciate other changes and modifications which may be made without departing from the spirit of my invention. For example, it will readily be apparent that the flexible cable could be attached at the end opposite from the attachment to the pilot arm 62 to other points on the mechanism which would have the same result of precluding the unfolded mechanism from tilting when a heavy load is applied to the head end of the mechanism. Therefore, I do not intend to be limited except by the scope of the following appended claims:

I claim:

1. A foldable sofa-sleeper mechanism adapted to be mounted upon a sofa frame and stored within a storage enclosure of the sofa frame, said mechanism comprising a bed frame having pivotally interconnected head, body, intermediate and foot sections each having a pair of opposed side rails, a mattress supporting fabric extending between said sections and connected thereto, a pair of center legs connected to a center actuating leg means operable to retract and extend said center legs, said mechanism being movable between a folded position in which said mechanism is contained within said storage enclosure of said sofa frame and said center legs are retracted, and an extended unfolded position in which said bed frame extends forwardly from said sofa frame and said center legs extend downwardly from said bed frame, the improvement comprising tilt prevention means for preventing tilting of the head section of the unfolded sofa-sleeper mechanism downwardly, said tilt prevention means including at least one flexible, non-stretchable cable connected to two locations on said mechanism such that the unfolded mechanism cannot tilt upwardly at the foot section of the mechanism without stretching the nonstretchable cable.

2. The sofa-sleeper mechanism of claim 1 in which the two locations to which said cable is connected are so positioned on said mechanism that said cable is taut when said mechanism is unfolded and is relaxed when said mechanism is folded.

3. The sofa-sleeper mechanism of claim 1 wherein each of said body section side rails are at least partially supported from a pivotally mounted pilot arm, and said cable is connected at one end to one of said pilot arms.

4. The sofa-sleeper mechanism of claim 3 wherein said other end of said cable is connected to one of said side rails of said mechanism.

5. The sofa-sleeper mechanism of claim 3 wherein said other end of said cable is connected to one of said side rails of said intermediate section of said mechanism.

6. The sofa-sleeper mechanism of claim 1 wherein said cable is a self-coiling cable which forms itself into a helical configuration when relaxed.

7. A foldable sofa-sleeper mechanism adapted to be mounted upon a sofa frame and stored within a storage enclosure of the sofa frame, said mechanism comprising a bed frame having pivotally interconnected head, body, intermediate and foot sections, said mechanism being movable between a folded position in which said mechanism is contained within said storage enclosure of said sofa frame and an extended unfolded position in which said bed frame extends forwardly in a generally planar attitude from said sofa frame, the improvement comprising tilt prevention means for preventing tilting of the head section of the unfolded sofa-sleeper mechanism downwardly, said tilt prevention means including at least one flexible, non-stretchable cable fixedly connected to two locations on said mechanism such that the unfolded mechanism cannot tilt upwardly at the foot section of the mechanism without stretching the nonstretchable cable.

8. The sofa-sleeper mechanism of claim 7 in which the two locations to which said cable is connected are so positioned on said mechanism that said cable is taut when said mechanism is unfolded and is relaxed when said mechanism is folded.

* * * * *